US010745638B2

(12) United States Patent
Cook et al.

(10) Patent No.: US 10,745,638 B2
(45) Date of Patent: Aug. 18, 2020

(54) MARINE DIESEL LUBRICATING COMPOSITION

(71) Applicant: The Lubrizol Corporation, Wickliffe, OH (US)

(72) Inventors: Stephen J. Cook, Belper (GB); Natasha K. Horn, Wheatley (GB); Shaun P. Carney, Aston on Trent (GB); Mark C. Davies, Pudong (CN); David M. Hobson, Cauldron (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 15/521,655

(22) PCT Filed: Oct. 30, 2015

(86) PCT No.: PCT/US2015/058247

§ 371 (c)(1),
(2) Date: Apr. 25, 2017

(87) PCT Pub. No.: WO2016/070002

PCT Pub. Date: May 6, 2016

(65) Prior Publication Data

US 2017/0247628 A1 Aug. 31, 2017

Related U.S. Application Data

(60) Provisional application No. 62/073,444, filed on Oct. 31, 2014.

(51) Int. Cl.

| | |
|---|---|
| ***C10L 1/22*** | (2006.01) |
| ***C10M 135/10*** | (2006.01) |
| ***C10M 169/04*** | (2006.01) |
| ***C10M 129/50*** | (2006.01) |
| ***C10M 133/44*** | (2006.01) |
| ***C10M 139/00*** | (2006.01) |
| *C10N 30/02* | (2006.01) |
| *C10N 30/04* | (2006.01) |
| *C10N 30/08* | (2006.01) |
| *C10N 30/10* | (2006.01) |
| *C10N 30/00* | (2006.01) |
| *C10N 40/26* | (2006.01) |
| *C10N 40/25* | (2006.01) |

(52) U.S. Cl.

CPC ..... *C10M 135/10* (2013.01); *C10M 129/50* (2013.01); *C10M 133/44* (2013.01); *C10M 139/00* (2013.01); *C10M 169/042* (2013.01); *C10M 169/045* (2013.01); *C10M 169/048* (2013.01); *C10M 2203/1006* (2013.01); *C10M 2203/108* (2013.01); *C10M 2203/1025* (2013.01); *C10M 2207/027* (2013.01); *C10M 2207/028* (2013.01); *C10M 2207/144* (2013.01); *C10M 2207/262* (2013.01); *C10M 2207/34* (2013.01); *C10M 2215/28* (2013.01); *C10M 2215/30* (2013.01); *C10M 2219/044* (2013.01); *C10M 2219/046* (2013.01); *C10M 2219/088* (2013.01); *C10M 2219/089* (2013.01); *C10M 2223/045* (2013.01); *C10M 2227/00* (2013.01); *C10N 2030/02* (2013.01); *C10N 2030/04* (2013.01); *C10N 2030/08* (2013.01); *C10N 2030/10* (2013.01); *C10N 2030/40* (2020.05); *C10N 2030/52* (2020.05); *C10N 2040/255* (2020.05); *C10N 2040/26* (2013.01)

(58) Field of Classification Search

CPC ..... C10M 159/22; C10M 159/24; C10M 135/10; C10M 2207/262; C10M 169/048; C10M 169/042; C10M 169/045; C10M 129/50; C10M 139/00; C10M 2207/028; C10M 2219/089; C10M 2219/088; C10M 2215/30; C10M 2223/045; C10M 2227/00; C10M 2203/108; C10M 2207/027; C10M 2207/144; C10M 2219/044; C10M 2219/046; C10N 2230/10; C10N 2230/40; C10N 2240/104; C10N 2230/02; C10N 2230/04; C10N 2230/52

USPC ..... 508/192

See application file for complete search history.

(56) References Cited

U.S. PATENT DOCUMENTS

| | | | | |
|---|---|---|---|---|
| 5,861,363 | A * | 1/1999 | Willis, Jr. | C08F 8/00 508/192 |
| 6,200,936 | B1 | 3/2001 | Moreton et al. | |
| 6,429,179 | B1 | 8/2002 | Skinner et al. | |
| 2004/0176257 | A1* | 9/2004 | Boffa | C10M 163/00 508/156 |
| 2006/0247138 | A1* | 11/2006 | Rosenbaum | C10G 2/32 508/110 |
| 2008/0234153 | A1 | 9/2008 | Matsui | |
| 2012/0214719 | A1 | 8/2012 | Garcia Ojeda | |

FOREIGN PATENT DOCUMENTS

| | | | |
|---|---|---|---|
| CA | 2813538 | A1 | 4/2012 |
| CA | 2818240 | A1 | 12/2013 |
| WO | 2013/119623 | A1 | 8/2013 |

* cited by examiner

*Primary Examiner* — Prem C Singh
*Assistant Examiner* — Francis C Campanell
(74) *Attorney, Agent, or Firm* — Iken Sans; Teresan Gilbert

(57) ABSTRACT

The invention provides a method of lubricating a 2-stroke marine diesel cylinder liner with a lubricating composition having a total base number of 10 to 25 mg KOH/g. The invention further provides a lubricating composition for lubricating the 2-stroke marine diesel cylinder liner.

11 Claims, No Drawings

MARINE DIESEL LUBRICATING COMPOSITION

CROSS REFERENCE TO RELATED APPLICATION

This application claims priority from PCT Application Serial No. PCT/US2015/058247 filed on Oct. 30, 2015, which claims the benefit of U.S. Provisional Application No. 62/073,444 filed on Oct. 31, 2014, both of which are incorporated in their entirety by reference herein.

FIELD OF INVENTION

The invention provides a method of lubricating a 2-stroke marine diesel cylinder liner with a lubricating composition having a total base number of 10 to 25 mg KOH/g. The invention further provides a lubricating composition for lubricating the 2-stroke marine diesel cylinder liner.

BACKGROUND OF THE INVENTION

Marine diesel engines such as a cross-head engine are typically lubricated with two different lubricants i.e., the first lubricant is for a cylinder liner and the second for a crankcase. The cylinder liner is typically lubricated with a cylinder oil (may be referred to as a MDCL), and the crankcase is lubricated by a system oil.

The cylinder oil, lubricates the inner walls of the engine cylinder and the piston ring pack. The lubricants are known to be used to assist in controlling corrosive and abrasive wear. The wear may be caused by unneutralised combustion products such as acids (typically sulphuric acid) being produced during combustion. Typically lubricants for MDCL have had a TBN of 40-50, or 70-100 mg KOH/g. There has been a trend for reduction in emissions (typically reduction of NOx formation, SOx formation) and a reduction in sulphated ash in engine oil lubricants.

US 2012/0214719 discloses a lubricating composition at least comprising: a base oil; and a detergent; wherein the detergent comprises at least 30 mol %, based on the total amount of detergent, of a sulphonate detergent having a BN (Base Number) of from 0.1 to 80 mg KOH/g; wherein the detergent comprises from 30 to 70 mol %, based on the total amount of detergent, of a phenate detergent; wherein the lubricating composition comprises at least 4 wt. % of detergent, based on the total weight of the composition; and wherein the lubricating composition has a TBN (total base number) (according to ASTM D 2896) of at least 10 mg KOH/g. The engine disclosed are slow- and medium-speed marine and stationary diesel engines that operate at high pressures, high temperatures and long-strokes. The problem disclosed is to improve deposit formation control properties.

CA 2818240 discloses a two-stroke, cross-head, slow-speed, compression-ignited marine engine is operated by: (i) fuelling it with a diesel fuel, as a pilot fuel, and with a low sulphur fuel, as a main fuel; and (ii) lubricating the engine cylinder(s) with a lubricant having a BN of 20 or less and having a detergent additive system comprising at least two different metal detergents each having one surfactant group selected from phenate, salicylate and sulphonate, or one or more complex metal detergents containing two or more different surfactant soap groups selected from phenate, salicylate and sulphonate. The sulphonate detergent disclosed in a dependent claim has a total base number (TBN) as determined by ASTM D 2896-98 of greater than 100.

CA 2813538 discloses a two-stroke, cross-head, slow-speed, compression-ignited marine engine is operated by: (i) fuelling it with a diesel fuel, as a pilot fuel, and with a low sulphur fuel, as a main fuel; and (ii) lubricating the engine cylinder(s) with a lubricant having a BN of 20 or less and having a detergent additive system comprising one or more different metal detergents having a surfactant group selected from phenate, salicylate and sulphonate, or one or more complex metal detergents containing two or more different surfactant soap groups selected from phenate, salicylate and sulphonate, and a distilled cashew nut shell liquid or hydrogenated distilled cashew nut shell liquid. A dependent claim describes the cylinder lubricant having a base number (BN) of 15 or less, preferably 5 to 15, or more preferably 10 to 15.

WO2013/119623 discloses sulphurized alkaline earth metal (e.g., calcium) dodecylphenate is prepared by reacting (i) dodecylphenol with (ii) calcium hydroxide or calcium oxide in an amount of about 0.3 to about 0.7 moles per mole of dodecylphenol charged and (iii) an alkylene glycol in an amount of about 0.13 to about 0.6 moles per mole of dodecylphenol charged; and reacting the product of the first step with sulphur in an amount of about 1.6 to about 3 moles per mole of dodecylphenol charged; and thereafter optionally reacting the product with additional calcium hydroxide or calcium oxide and with carbon dioxide so as to form an overbased phenate.

U.S. Pat. No. 6,429,179 discloses a calcium overbased detergent which is substantially free from inorganic halides and ammonium salts, formed by treating with an overbasing agent, a mixture containing at least one basic calcium compound and a surfactant system comprising at least two surfactants, at least one of which is a sulphurized or non-sulphurized phenol and at least one other of which is a surfactant other than a phenol surfactant, the proportion of the said phenol in the surfactant system being at least 45 mass % and the overbased detergent having a TBN: % surfactant ratio of at least 14. The calcium overbased detergent is useful for MDCL engines.

SUMMARY OF THE INVENTION

The objectives of the present invention include providing a lubricating composition having at least one of the following properties (i) reduced or equivalent wear, (ii) decreased formation of deposits (such as that formed by an accumulation of un-neutralized calcium or magnesium carbonate form an overbased detergent) and/or (iii) improved cleanliness.

With the exception of detergent additives, as used herein, reference to the amounts of additives present in the lubricant composition disclosed are quoted on an oil free basis, i.e., amount of actives, unless otherwise indicated. For detergent additives the amounts present in the lubricant composition disclosed are quoted on an oil containing basis.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

In one embodiment the disclosed technology provides a lubricating composition comprising:

an oil of lubricating viscosity, alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the sulphonate detergent provides no more than 50% of the total base number derived from a detergent, and the lubricating composition has a total base number of 10 to 25 mg KOH/g (as measured by ASTM D2986-11).

In one embodiment the disclosed technology provides a lubricating composition comprising:

an oil of lubricating viscosity, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

In one embodiment the disclosed technology provides a lubricating composition comprising:

an oil of lubricating viscosity, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the phenol-based detergent may be chosen from a non-sulphur containing phenate, a sulphur-coupled phenate, a salixarate, a salicyclate, a saligenin, and mixtures thereof, the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

In one embodiment the disclosed technology provides a lubricating composition comprising:

an oil of lubricating viscosity, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the phenol-based detergent may be sulphur-free, the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

In one embodiment the disclosed technology provides a lubricating composition comprising:

an oil of lubricating viscosity, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the phenol-based detergent may be chosen from, a salixarate, a salicyclate and mixtures thereof, the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

In one embodiment the disclosed technology provides a lubricating composition comprising:

an oil of lubricating viscosity, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the phenol-based detergent may be a salixarate, or mixtures thereof, the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

The lubricating composition of the disclosed technology described herein in one embodiment further comprises a dispersant typically chosen from a succinate, a succinimide, a succinamide, or mixtures thereof. Typically the dispersant may be borated on non-borated (typically a borated or non-borated polyisobutylene succinimide).

In one embodiment the dispersant may be a polyisobutylene succinimide, or mixtures thereof. For example the dispersant may be a mixture of a borated polyisobutylene succinimide and a non-borated polyisobutylene succinimide.

The lubricating composition of the disclosed technology may have a total base number of 12 to 20 mg KOH/g, or 12 to 18 mg KOH/g.

The oil of lubricating viscosity may comprise an API Group I, II, III, IV, V, or mixtures thereof base oil. Typically the oil of lubricating viscosity may be an API Group I or II, or mixtures thereof base oil.

The lubricating composition in one embodiment may further comprise a thickening agent. The thickening agent may be present at 0.1 wt % to 30 wt %, or 0.5 to 25 wt % or 1 to 20 wt %.

The thickening agent may be chosen from a brightstock, a polymethacrylate a polyisobutylene having a 1500 to 8000 $mm^2/s$ at 100° C. (as disclosed in International Publication WO 99/64543), or polyisobutylene succinic anhydride, wherein the polyisobutylene has a number average molecular weight of 450 to 20,000, or 550 to 10,000, or 750 to 5000, or 1500 to 2500. Brightstock may be often the thickening agent.

The polyisobutylene succinic anhydride is disclosed for example in is described in WO 93/03121, page 33, line 10 to page 37, line 20.

The lubricating composition disclosed herein may have a kinematic viscosity (as measured by ASTM D445 at 100° C.) of 12 $mm^2/s$ or 15 $mm^2/s$ to 26.1 $mm^2/s$ and in another embodiment 12 $mm^2/s$ or 15 $mm^2/s$ to 21.9 $mm^2/s$.

The lubricating composition may be a SAE 50 or SAE 60 lubricant.

Typically the lubricating composition may have a total viscosity of 12 $mm^2/s$ or 15 $mm^2/s$ to 26.1 $mm^2/s$ is a SAE 60 grade, and an SAE 50 grade lubricating composition has a viscosity of 15 $mm^2/s$ or 16.3 $mm^2/s$ to 21.9 $mm^2/s$.

In one embodiment the disclosed technology provides a method of lubricating a 2-stroke marine diesel internal combustion engine comprising supplying to the internal combustion engine a lubricating composition disclosed herein. The lubricating composition is typically used to lubricate the 2-stroke marine diesel cylinder liner.

The two-stroke marine diesel engine may be a 2-stroke, cross-head slow-speed compression-ignited engine usually has a speed of below 200 rpm, such as, for example, 10-200 rpm or 60-200 rpm.

The fuel of the 2-stroke marine diesel engine may contain a sulphur content of up to 5000 ppm, or up to 3000, or up to 1000 ppm of sulphur. For example the sulphur content may be 200 ppm to 5000 ppm, or 500 ppm to 4500 ppm, or 750 ppm to 2000 ppm.

In one embodiment the invention provides for the use of the lubricating composition disclosed herein to provide a 2-stroke marine diesel engine with at least one of the following properties (i) reduced or equivalent wear, (ii) decreased deposit formation, and/or (iii) improved cleanliness.

DETAILED DESCRIPTION OF THE INVENTION

The present invention provides a lubricant composition, a method for lubricating a mechanical device and the use as disclosed above.

Metal Sulphonate Detergent

The metal sulphonate detergent may be a netural or overbased detergent.

Overbased detergents are known in the art. Overbased materials, otherwise referred to as overbased or superbased salts, are generally single phase, homogeneous systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, typically carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio is also explained in standard textbook entitled "Chemistry and Technology of Lubricants", Third Edition, Edited by R. M. Mortier and S. T. Orszulik, Copyright 2010, page 219, sub-heading 7.25.

Overbased sulphonates typically have a TBN of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378.

In one embodiment, the sulphonate detergent may be a branched alkylbenzene sulphonate detergent. Branched alkylbenzene sulphonate may be prepared from isomerized alpha olefins, oligomers of low molecular weight olefins, or combinations thereof. Preferred oligomers include tetramers, pentamers, and hexamers of propylene and butylene. In other embodiments, the alkylbenzene sulphonate detergent may be derived from a toluene alkylate, i.e. the alkylbenzene sulphonate has at least two alkyl groups, at least one of which is a methyl group, the other being a linear or branched alkyl group as described above.

The metal sulphonate detergent may be an alkaline earth metal or alkali metal sulphonate. For example the metal may be sodium, calcium, barium, or magnesium. Typically other detergent may be sodium, calcium, or magnesium containing detergent (typically, calcium, or magnesium containing detergent). In one embodiment the metal may be calcium.

In one embodiment the overbased sulphonate detergent comprises an overbased calcium sulphonate. The calcium sulphonate detergent may have a metal ratio of 18 to 40 and a TBN of 300 to 500, or 325 to 425. For example a 300 TBN metal sulphonate detergent may comprise calcium sulphonate detergent having a metal ratio of 16 to 20, or a magnesium sulphonate detergent having a metal ratio of 12 to 40.

In one embodiment the overbased sulphonate detergent comprises an overbased magnesium sulphonate. The TBN may range from 300 to 500, or 325 to 425. The magnesium sulphonate detergent having a metal ratio of 14 to 25.

If present the amount of overbased metal sulphonate may be present from 0.1 to 6 wt %, or 0.2 to 5 wt %, 0.3 to 4 wt %, or 0.5 to 3 wt %.

The metal sulphonate detergent may have a TBN of less than 100, or 20 to 90, or 30 to 90 TBN. The metal ratio my range from 1 to 6, or 1 to 5.

If present the amount of the metal sulphonate detergent having a TBN of less than 100 may be present from 0.5 to 8 wt %, or 1 to 6 wt %, 1.5 to 6 wt %, or 2.5 to 5 wt %.

In one embodiment the metal sulphonate detergent may be in the form of a mixture of sulphonate detergents. For example the mixture may comprise (a) a TBN of less than 100 having a metal ratio of 1 to 6; and (b) a metal sulphonate detergent having a TBN of 300 to 500, and a metal ratio of 18 to 40. Typically the metal of the metal sulphonate may be calcium for both detergents.

When in the form of a mixture of metal sulphonate detergents, the amount of the amount of overbased metal sulphonate may be present from 0.1 to 6 wt %, or 0.2 to 5 wt %, 0.3 to 4 wt %, or 0.05 to 3 wt %; and the metal sulphonate detergent having a TBN of less than 100 and a metal ratio of 1 to 6 may be present from 0.5 to 8 wt %, or 1 to 6 wt %, 1.5 to 6 wt %, or 2.5 to 5 wt %.

When the overbased metal sulphonate and the metal sulphonate detergent having a TBN of less than 100 are both present, typically the metal sulphonate detergent having a TBN of less than 100 may be present at more than the overbased sulphonate detergent. The metal sulphonate detergent having a TBN of less than 100 may contribute 50 to 90%, or 60 to 80% of the overall amount of sulphonate detergent.

The sulphonate detergent provides no more than 50%, or 10 to 40%, or 20 to 30% of the total base number derived from a detergent.

Alkaline Earth Metal Phenol-Based Detergent

The alkaline earth metal phenol-based detergent may be present in amount to provide at least 3.5 wt % (or 3.5 to 10 wt %, or 4 to 8 wt %) phenol-containing soap to the lubricating composition, wherein the phenol-based detergent may be chosen from a non-sulphur containing phenate, a sulphur-coupled phenate, a salixarate, a salicylate, a saligenin, and mixtures thereof.

In one embodiment the lubricating composition further comprises a non-sulphur containing phenate, or sulphur containing phenate, or mixtures thereof. The non-sulphur containing phenates and sulphur containing phenates and known in the art.

The non-sulphur containing phenate, or sulphur containing phenate may be neutral or overbased. Typically an overbased non-sulphur containing phenate, or a sulphur containing phenate have a total base number of 180 to 450 TBN and a metal ratio of 2 to 15, or 3 to 10. A neutral non-sulphur containing phenate, or sulphur containing phenate may have a TBN of 80 to less than 180 and a metal ratio of 1 to less than 2, or 0.05 to less than 2.

Phenate detergents are typically derived from p-hydrocarbyl phenols. Alkylphenols of this type may be coupled with sulfur and overbased, coupled with aldehyde and overbased, or carboxylated to form salicylate detergents. Suitable alkylphenols include those alkylated with oligomers of propylene, i.e. tetrapropenylphenol (i.e. p-dodecylphenol or PDDP) and pentapropenylphenol. Suitable alkylphenols also include those alkylated with oligomers of butane, especially tetramers and pentamers of n-butenes. Other suitable alkylphenols include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent derived from PDDP. In one embodiment, the lubricant composition comprises a phenate detergent that is not derived from PDDP. In one embodiment, the lubricating composition comprises a phenate detergent prepared from PDDP wherein the phenate detergent contains less than 1.0 wt % unreacted PDDP, or less than 0.5 weight percent unreacted PDDP, or substantially free of PDDP.

In one embodiment the lubricating composition may further comprise a neutral non-sulphur containing phenate, or sulphur containing phenate may have a TBN of 80 to less than 180 and a metal ratio of 1 to less than 2, or 0.05 to less than 2.

The non-sulphur containing phenate, or sulphur containing phenate may be in the form of a calcium or magnesium non-sulphur containing phenate, or sulphur containing phenate (typically calcium non-sulphur containing phenate, or sulphur containing phenate).

When present the non-sulphur containing phenate, or sulphur containing phenate may be present at 0.1 to 10 wt %, or 0.5 to 8 wt %, or 1 to 6 wt %, or 2.5 to 5.5 wt % of the lubricating composition.

In one embodiment the lubricating composition may be free of an overbased phenate, and in a different embodiment the lubricating composition may be free of a non-overbased phenate. In another embodiment the lubricating composition may be free of a phenate detergent.

In one embodiment the lubricating composition further comprises a salicylate detergent that may be neutral or overbased. The salicylates and known in the art. The salicylate detergent may have a TBN of 50 to 400, or 150 to 350, and a metal ratio of 0.5 to 10, or 0.6 to 2.

Suitable salicylate detergents included alkylated salicylic acid, or alkylsalicylic acid. Alkylsalicylic acid may be prepared by alkylation of salicylic acid or by carbonylation of alkylphenol. When alkylsalicylic acid is prepared from alkylphenol, the alkylphenol is selected in a similar manner as the phenates described above. In one embodiment, alkylsalicylate of the invention include those alkylated with oligomers of propylene, i.e. tetrapropenylphenol (i.e. p-dodecylphenol or PDDP) and pentapropenylphenol. Suitable alkylphenols also include those alkylated with oligomers of butane, especially tetramers and pentamers of n-butenes. Other suitable alkylphenols include those alkylated with alpha-olefins, isomerized alpha-olefins, and polyolefins like polyisobutylene. In one embodiment, the lubricating composition comprises a salicylate detergent prepared from PDDP wherein the phenate detergent contains less than 1.0 weight percent unreacted PDDP, or less than 0.5 weight percent unreacted PDDP, or substantially free of PDDP.

When present the salicylate may be present at 0.01 to 10 wt %, or 0.1 to 6 wt %, or 0.2 to 5 wt %, 0.5 to 4 wt %, or 1 to 3 wt % of the lubricating composition.

In one embodiment the lubricating composition further comprises a salixarate detergent. The salixarate may be often represented by one or a mixture of substantially linear compounds comprising at least one unit of the formulae (I) or (II):

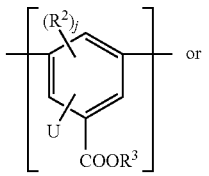

(I)

-continued (II)

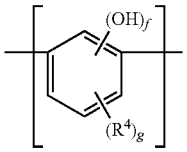

each end of the compound having a terminal group of formulae (III) or (IV):

(III)

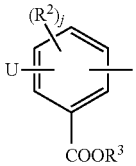

(IV)

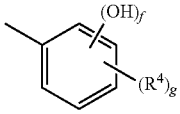

such groups being linked by divalent bridging groups, which may be the same or different for each linkage; wherein in formulas (I)-(IV) f may be 1, 2 or 3, 1 or 2; U may be —OH, —$NH_2$—$NHR^1$, —$N(R^1)_2$ or mixtures thereof, $R^1$ may be a hydrocarbyl group containing 1 to 5 carbon atoms; $R^2$ may be hydroxyl or a hydrocarbyl group and j may be 0, 1, or 2; $R^3$ *may be* hydrogen or a hydrocarbyl group; $R^4$ may be a hydrocarbyl group or a substituted hydrocarbyl group; g may be 1, 2 or 3, provided at least one $R^4$ group contains 8 or more carbon atoms; and wherein the molecules on average contain at least one of unit (I) or (III) and at least one of unit (II) or (IV) and the ratio of the total number of units (I) and (III) to the total number of units of (II) and (IV) in the composition overall may be 0.1:1 to 2:1, although individual molecules within the composition may fall outside this range.

The U group in formulae (i) and (iii) may be located in one or more positions ortho, meta, or para to the —$COOR^3$ group. Typically the U group may be located ortho to the —$COOR^3$ group. When the U group may be a —OH group, formulae (i) and (iii) are derived from 2-hydroxybenzoic acid (often called salicylic acid), 3-hydroxybenzoic acid, 4-hydroxybenzoic acid or mixtures thereof. When U may be a —$NH_2$ group, formulae (i) and (iii) are derived from 2-aminobenzoic acid (often called anthranilic acid), 3-aminobenzoic acid, 4-aminobenzoic acid or mixtures thereof.

The divalent bridging group, which may be the same or different in each occurrence, includes —$CH_2$— (methylene bridge) and —$CH_2OCH_2$— (ether bridge), either of which may be derived from an aldehyde such as formaldehyde or a formaldehyde equivalent (e.g., paraform, formalin), ethanal or propanal.

The metal of the metal salixarate may be often monovalent, di-valent or mixtures thereof. Typically the metal may be chosen from an alkali metal or alkaline earth metal such as magnesium, calcium, potassium or sodium, although magnesium, calcium, potassium or mixtures thereof are commonly used (typically calcium).

It is believed that a significant fraction of salixarate molecules (prior to neutralisation) may be represented on average by the following formula:

(V)

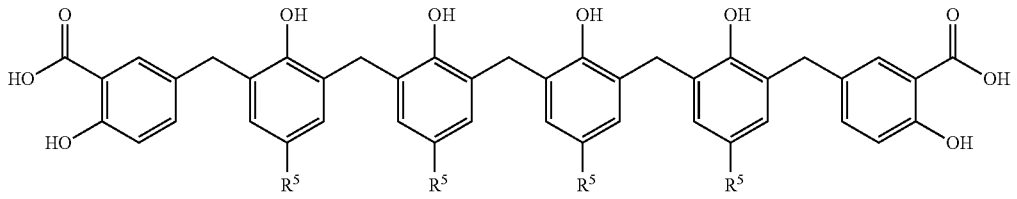

wherein each $R^5$ can be the same or different, and are hydrogen or an alkyl group, provided at least one $R^5$ may be alkyl. In one embodiment, $R^5$ may be a polyisobutene group (especially of molecular weight 200 to 1,000, or about 550). Significant amounts of di- or trinuclear species may also be present containing one salicylic end group of formula (III). The salixarate detergent may be used alone or with other detergents.

Salixarate derivatives and methods of their preparation are described in greater detail in U.S. Pat. No. 6,200,936 and PCT Publications WO 01/56968 and WO 03/18728. It is believed that the salixarate derivatives have a predominantly linear, rather than macrocyclic, structure, although both structures are intended to be encompassed by the term "salixarate." Additionally Linear" does not exclude branching or other structures in the substituent R groups.

The salixarate may have a TBN of 50 to 300, or 100 to 260 and a metal ratio of 1 to 10, or 2 to 6.5.

When present the salixarate may be present at 0.01 to 10 wt %, or 0.1 to 6 wt %, or 0.2 to 5 wt %, 0.5 to 4 wt %, or 1 to 3 wt % of the lubricating composition.

In one embodiment the lubricating composition further comprises a salixarene. The salixarene has the same organic structure as the salixarate, except the salixarene is not salted with a metal.

The salixarene may have a TBN of 0.5 to 20, or 0.5 to 2; and metal ratio of 0.01 to 1, or 0.01 to 0.1.

When present the salixarene may be present at 0.01 to 10 wt %, or 0.1 to 6 wt %, or 0.2 to 5 wt %, 0.5 to 4 wt %, or 1 to 3 wt % of the lubricating composition.

In one embodiment the lubricating composition may comprise salixarene present at 0.05 to 3 wt %, or 0.1 to 2.5 wt %, or 0.25 to 2 wt %, 0.5 to 1.5 of the lubricating composition; and the lubricating composition may comprise salixarate present at 0.05 to 3 wt %, or 0.1 to 2.5 wt %, or 0.25 to 2 wt %, 0.5 to 1.5 of the lubricating composition.

In one embodiment the lubricating composition further comprises a saligenin detergent. The saligenin may be a calcium or magnesium (typically magnesium) detergent that maybe represented by the formula:

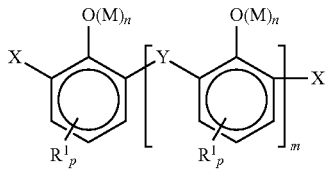

wherein X may be —CHO or —$CH_2OH$, Y comprises —$CH_2$— or —$CH_2OCH_2$—, and wherein such —CHO groups comprise at least 10 mole percent of the X and Y groups; M may be a mono- or di-valent metal ion. Each n may be independently 0 or 1. $R^1$ may be a hydrocarbyl group containing 1 to 60 carbon atoms, m may be 0 to 10, and when m>0, one of the X groups can be H; each p may be independently 0, 1, 2 or 3, or typically 1; and that the total number of carbon atoms in all $R^1$ groups may be at least 7.

The number of magnesium or calcium (typically magnesium) ions in the composition may be typically 10-100% of the amount required for complete neutralisation, or, in another embodiment, 40-90%, or alternatively 60-80% neutralisation by metal.

Most of the rings may contain at least one $R^1$ substituent, which may be a hydrocarbyl group, typically an alkyl group, containing 1 to 60 carbon atoms, typically 7 to 28 carbon atoms, more typically 9 to 18 carbon atoms. It may be understood that $R^1$ will normally comprise a mixture of various chain lengths, so that the foregoing numbers will normally represent an average number of carbon atoms in the $R^1$ groups (number average). $R^1$ can be linear or branched. Each ring in the structure will be substituted with 0, 1, 2, or 3 such $R^1$ groups (that is, p=0, 1, 2, or 3), most typically 1, although different rings in a given molecule may contain different numbers of such substituents. At least one aromatic ring in the molecule must contain at least one $R^1$ group, and the total number of carbon atoms in all the $R^1$ groups in the molecule segment should be at least 7, typically at least 12.

In the above structure the X and Y groups may be seen as groups derived from formaldehyde or a formaldehyde source, by condensative reaction with the aromatic molecule. While various species of X and Y may be present in the molecules in question, the commonest species comprising X are —CHO (aldehyde functionality) and —$CH_2OH$ (hydroxymethyl functionality); similarly the commonest species comprising Y are —$CH_2$— (methylene bridge) and —$CH_2OCH_2$— (ether bridge).

In one embodiment, X may be at least in part —CHO, and such —CHO groups comprise at least 10, 12, or 15 mole percent of the X and Y groups. Typically the —CHO groups comprise 20 to 60 mole percent of the X and Y groups and more typically 25 to 40 mole percent of the X and Y groups.

In another embodiment, X may be at least in part —$CH_2OH$ and such —$CH_2OH$ groups comprise 10 to 50 mole percent of the X and Y groups, typically 15 to 30 mole percent of the X and Y groups.

In an embodiment in which m may be non-zero, Y may be at least in part —$CH_2$—, and such —$CH_2$— groups comprise 25 to 55 mole percent of the X and Y groups, typically 32 to 45 mole percent of the X and Y groups.

In another embodiment Y may be at least in part —$CH_2OCH_2$—, and such —$CH_2OCH_2$— groups comprise 5 to 20 mole percent of the X and Y groups, and typically 10 to 16 mole percent of the X and Y groups.

The relative amounts of the various X and Y groups depends to a certain extent on the conditions of synthesis of the molecules. Under many conditions the amount of —$CH_2OCH_2$— groups may be relatively small compared to the other groups and may be reasonably constant at 13 to 17 mole percent. Ignoring the amount of such ether groups and focusing on the relative amounts of the —CHO, —$CH_2OH$, and —$CH_2$— groups, it has been found that often compositions have the following relative amounts of these three groups, the total of such amounts in each case being normalized to equal 100%:

—CHO: 15-100%, typically 20-80%, more typically 25-40%

—$CH_2OH$: 0-54%, typically 2-46%, more typically 10-40% —$CH_2$: 0-64%, typically 18-64%, more typically 20-60%

Saligenin derivatives and methods of their preparation are described in greater detail in U.S. Pat. No. 6,310,009.

When present the saligenin may be present at 0.01 to 10 wt %, or 0.1 to 6 wt %, or 0.2 to 5 wt %, 0.5 to 4 wt %, or 1 to 3 wt % of the lubricating composition.

The alkaline earth metal phenol-based detergent may also include "hybrid" detergents formed with mixed surfactant systems including phenate and/or sulphonate components, e.g., phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may be an API Group IV oil, or mixtures thereof, i.e., a polyalphaolefin. The polyalphaolefin may be prepared by metallocene catalyzed processes or from a non-metallocene process.

The oil of lubricating viscosity comprises an API Group I, Group II, Group III, Group IV, Group V oil or mixtures thereof.

Often the oil of lubricating viscosity may be an API Group I, Group II, Group II+, Group III, Group IV oil or mixtures thereof. Alternatively the oil of lubricating viscosity is often an API Group I, Group II oil or mixtures thereof.

The amount of the oil of lubricating viscosity present is typically the balance remaining after subtracting from 100 wt % the sum of the amount of the additive as described herein above, and the other performance additives.

The lubricating composition may be in the form of a concentrate and/or a fully formulated lubricant. If the lubricating composition of the invention is in the form of a concentrate (which may be combined with additional oil to form, in whole or in part, a finished lubricant), the ratio of the of components of the invention to the oil of lubricating viscosity and/or to diluent oil include the ranges of 1:99 to 99:1 by weight, or 80:20 to 10:90 by weight.

Dispersant

In one embodiment the lubricant composition may further include a dispersant, or mixtures thereof. When present the dispersant may be present at 0.01 wt % to 10 wt %, 0.1 wt % to 8 wt %, or 0.5 wt % to 6 wt %, or 1 wt % to 4 wt % of the lubricant composition.

The dispersant may be chosen from a succinimide dispersant, a Mannich dispersant, a succinamide dispersant, a polyolefin succinic acid ester, amide, or ester-amide, or mixtures thereof.

The dispersant may be present as a single dispersant. The dispersant may be present as a mixture of two or more (typically two or three) different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be chosen from ethylenediamine, diethylenetriamine, triethylenetetramine, tetraethylenepentamine, pentaethylenehexamine, polyamine still bottoms, and mixtures thereof.

In one embodiment the succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an aminoindazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from C2-C6 epoxides such as ethylene oxide, propylene oxide, and butylene oxide. Examples of polyether polyamines are sold under the Jeffamine® brand and are commercially available from Hunstman Corporation located in Houston, Tex.

Another class of ashless dispersant is ester dispersants. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Aromatic succinate esters may also be prepared as described in United States Patent Publication 2010/0286414.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide may be polyisobutylene succinimide. Typically the polyisobutylene from which polyisobutylene succinic anhydride may be derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant may be borated. In one embodiment the post-treated dispersant may be reacted with dimercaptothiadiazoles. In one embodiment the post-treated dispersant may be reacted with phosphoric or phosphorous acid. In one embodiment the post-treated dispersant may be reacted with terephthalic acid and boric acid (as described in US Patent Application US2009/0054278.

In one embodiment the dispersant may be borated or non-borated. Typically a borated dispersant may be a succinimide dispersant. In one embodiment, the ashless dispersant may be boron-containing, i.e., has incorporated boron and delivers said boron to the lubricant composition. The boron-containing dispersant may be present in an amount to deliver at least 25 ppm boron, at least 50 ppm boron, or at least 100 ppm boron to the lubricant composition. In one embodiment, the lubricant composition may be free of a boron-containing dispersant, i.e. delivers no more than 10 ppm boron to the final formulation.

The dispersant may be prepared/obtained/obtainable from reaction of succinic anhydride by an "ene" or "thermal" reaction, by what may be referred to as a "direct alkylation process." The "ene" reaction mechanism and general reaction conditions are summarized in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process may be known to a person skilled in the art. The chlorine-assisted process may produce a dispersant that may be a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may have a carbonyl to nitrogen ratio (CO:N ratio) of 5:1 to 1:10, 2:1 to 1:10, or 2:1 to 1:5, or 2:1 to 1:2. In one embodiment the dispersant may have a CO:N ratio of 2:1 to 1:10, or 2:1 to 1:5, or 2:1 to 1:2, or 1:1.4 to 1:0.6.

In one embodiment the dispersant may be a succinimide dispersant may comprise a polyisobutylene succinimide, wherein the polyisobutylene from which polyisobutylene succinimide may be derived has a number average molecular weight of 350 to 5000, or 750 to 2500.

In one embodiment the lubricating composition further comprises a mixture of a borated and a non-borated dispersant (typically both the borated and non-borated dispersants are based upon a succinimide.

The dispersant may typically comprise a dispersant package of two or more dispersants. The dispersant package may comprise:

0.1 wt % to 4 wt %, 0.1 to 3 wt %, or 0.2 wt % to 2 wt %, or 0.3 wt % to 1 wt % of a borated polyisobutylene succinimide dispersant, wherein the polyisobutylene from which the borated polyisobutylene succinimide may be derived has a number average molecular weight of 550 to 2500, or 550 to 1150, and 0.1 wt % to 6 wt %, or 0.2 wt % to 5 wt %, 0.5 wt % to 4 wt % 0.5 wt % to 3 wt % of a non-borated polyisobutylene succinimide, wherein the polyisobutylene from which polyisobutylene succinimide may be derived has a number average molecular weight of 350 to 5000, or 750 to 3000 or 1350 to 2500.

Other Performance Additives

A lubricant composition may be prepared by adding the additives disclosed herein and to an oil of lubricating viscosity, optionally in the presence of other performance additives (as described herein below).

The lubricant composition of the invention may further include other additives. In one embodiment the invention provides a lubricant composition further comprising at least one of a dispersant, an antiwear agent such as zinc dialkyldithiophosphate, a dispersant viscosity modifier, a friction modifier, a viscosity modifier, an antioxidant, a foam inhibitor, a demulsifier, a pour point depressant or mixtures thereof. In one embodiment the invention provides a lubricant composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), or mixtures thereof.

Typically the lubricating composition disclosed herein does not contain a viscosity modifier or dispersant viscosity modifier.

Typically the lubricating composition disclosed herein does not contain an antioxidant or corrosion inhibitor.

Typically the lubricating composition disclosed herein does not contain a foam inhibitor, a demulsifier, a pour point depressant or mixtures thereof.

In one embodiment the lubricating composition disclosed herein does not contain zinc dialkyldithiophosphate, a viscosity modifier, or a dispersant viscosity modifier.

In one embodiment the lubricating composition does not further comprise friction modifier, or mixtures thereof.

In one embodiment the lubricating composition does further comprise zinc dialkyldithiophosphate. When present the zinc dialkyldithiophosphate may be present at 0.1 wt % to 5 wt %, or 0.2 wt % to 3 wt %, or 0.5 to 2 wt % of the lubricating composition.

In one embodiment zinc dialkyldithiophosphate is not present.

The lubricating composition may in one embodiment further comprise an ashless antiwear agent. The ashless antiwear agent may be present at 0 wt % to 3 wt %, or 0.01 wt % to 2 wt %, or 0.1 wt % to 1 wt % of the lubricant composition.

In one embodiment, the ashless antiwear agent may be derived from alpha-oxo carbonyl compounds, such as alpha-hydroxycarboxylic acids, alpha-hydroxyketones, ether analogues of these alpha-hydroxy compounds, and mixtures thereof. Suitable compounds include hydrocarbyl esters, amides, or imides (as appropriate) of tartaric acid, citric acid, malic acid, lactic acid, mandelic acid, glycolic acid, poly (glycolic)acid, tetrahydrofuran-2-carboxylic acid, 2-furanoic acid. The hydrocarbyl esters, amides, or imides may be derived from hydrocarbyl groups of 1 to 32 carbon atoms, 4 to 24 carbon atoms, or 6 to 18 carbon atoms.

The ashless antiwear agent may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the friction modifier mixture from 5 to 95, or 10 to 90, or 20 to 85, or 20 to 80 weight percent of said mixture. The aliphatic carboxylic acids (especially a monocarboxylic acid) which form the esters are those acids containing 12 to 24 carbon atoms and in one aspect 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol may be diethylene glycol, triethylene glycol, glycerol, sorbitol, pentaerythritol or dipentaerythritol.

The commercially available monoester known as "glycerol monooleate" is believed to include 60±5 percent by weight of the chemical species glycerol monooleate, along with 35±5 percent glycerol dioleate, and less than 5 percent trioleate and oleic acid. The amounts of the monoesters, described above, are calculated based on the actual, corrected, amount of polyol monoester present in any such mixture.

The ashless antiwear agent may in one embodiment be a borated ester. The borated ester may be prepared by the reaction of a boron compound and at least one compound selected from epoxy compounds, halohydrin compounds, epihalohydrin compounds, alcohols and mixtures thereof. Typically the alcohols include monohydric alcohols, dihydric alcohols, trihydric alcohols or higher alcohols.

Boron compounds suitable for preparing the borate ester include a boric acid (including metaboric acid, $HBO_2$, orthoboric acid, $H_3BO_3$, and a tetraboric acid, $H_2B_4O_7$), a boric oxide, a boron trioxide and an alkyl borate. The borate ester may also be prepared from boron halides. The borated ester further contains at least one hydrocarbyl group often containing about 8 to about 30 carbon atoms.

The ashless antiwear agent may be represented by the formula:

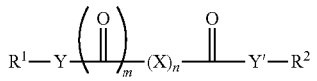

wherein

Y and Y' are independently —O—, >NH, >$NR^3$, or an imide group formed by taking together both Y and Y' groups and forming a $R^1$—N< group between two >C═O groups;

X may be independently —Z—O—Z'—, >$CH_2$, >$CHR^4$, >$CR^4R^5$, >$C(OH)(CO_2R^2)$, >$C(CO_2R^2)_2$, or >$CHOR^6$;

Z and Z' are independently >$CH_2$, >$CHR^4$, >$CR^4R^5$, >$C(OH)(CO_2R^2)$, or >$CHOR^6$;

n may be 0 to 10, with the proviso that when n=1, X may be not >$CH_2$, and when n=2, both X's are not >$CH_2$;

m may be 0 or 1;

$R^1$ may be independently hydrogen or a hydrocarbyl group, typically containing 1 to 150 carbon atoms, with the proviso that when $R^1$ may be hydrogen, m may be 0, and n may be more than or equal to 1;

$R^2$ may be a hydrocarbyl group, typically containing 1 to 150 carbon atoms;

$R^3$, $R^4$ and $R^5$ are independently hydrocarbyl groups; and $R^6$ may be hydrogen or a hydrocarbyl group, typically containing 1 to 150 carbon atoms.

Alternatively, the ashless antiwear agent may be represented by the formulae:

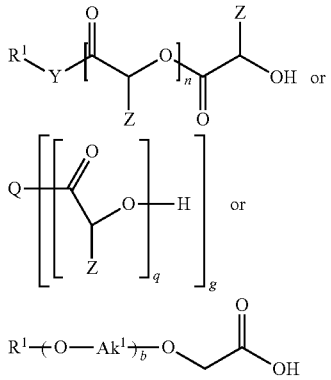

wherein

Y may be independently oxygen or >NH or >$NR^1$;

$R^1$ may be independently a hydrocarbyl group, typically containing 4 to 30, or 6 to 20, or 8 to 18 carbon atoms;

Z may be hydrogen or methyl;

Q may be the residue of a diol, triol or higher polyol, a diamine, triamine, or higher polyamine, or an aminoalcohol (typically Q may be a diol, diamine or aminoalcohol) g may be 2 to 6, or 2 to 3, or 2;

q may be 1 to 4, or 1 to 3 or 1 to 2;

n may be 0 to 10, 0 to 6, 0 to 5, 1 to 4, or 1 to 3; and $Ak^1$ may be an alkylene group containing 1 to 5, or 2 to 4 or 2 to 3 (typically ethylene) carbon atoms; and b may be 1 to 10, or 2 to 8, or 4 to 6, or 4.

The ashless antiwear agent may be known and may for example be described in International publication WO 2011/022317, and also in granted U.S. Pat. Nos. 8,404,625, 8,530,395, and 8,557,755.

In one embodiment the disclosed technology provides a lubricating composition consisting essentially of:

an oil of lubricating viscosity, a dispersant package of:

0.1 wt % to 4 wt %, 0.1 to 3 wt %, or 0.2 wt % to 2 wt %, or 0.3 wt % to 1 wt % of a borated polyisobutylene succinimide dispersant, wherein the polyisobutylene from which the borated polyisobutylene succinimide may be derived has a number average molecular weight of 550 to 2500, or 550 to 1150, and 0.1 wt % to 6 wt %, or 0.2 wt % to 5 wt %, 0.5 wt % to 4 wt % 0.5 wt % to 3 wt % of a non-borated polyisobutylene succinimide, wherein the polyisobutylene from which polyisobutylene succinimide may be derived has a number average molecular weight of 350 to 5000, or 750 to 3000 or 1350 to 2500 alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the sulphonate detergent provides no more than 50% of the total base number derived from a detergent, and the lubricating composition has a total base number of 10 to 25 mg KOH/g.

In one embodiment the disclosed technology provides a lubricating composition consisting essentially of:

an oil of lubricating viscosity, a dispersant package of:

0.1 wt % to 4 wt %, 0.1 to 3 wt %, or 0.2 wt % to 2 wt %, or 0.3 wt % to 1 wt % of a borated polyisobutylene succinimide dispersant, wherein the polyisobutylene from which the borated polyisobutylene succinimide may be derived has a number average molecular weight of 550 to 2500, or 550 to 1150, and 0.1 wt % to 6 wt %, or 0.2 wt % to 5 wt %, 0.5 wt % to 4 wt % 0.5 wt % to 3 wt % of a non-borated polyisobutylene succinimide, wherein the polyisobutylene from which polyisobutylene succinimide may be derived has a number average molecular weight of 350 to 5000, or 750 to 3000 or 1350 to 2500, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the sulphonate detergent provides no more than 50% of the total base number derived from a detergent, and the lubricating composition has a total base number of 10 to 25 mg KOH/g an oil of lubricating viscosity, alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

In one embodiment the disclosed technology provides a lubricating composition consisting essentially of:

an oil of lubricating viscosity, a dispersant package of:

0.1 wt % to 4 wt %, 0.1 to 3 wt %, or 0.2 wt % to 2 wt %, or 0.3 wt % to 1 wt % of a borated polyisobutylene succinimide dispersant, wherein the polyisobutylene from which the borated polyisobutylene succinimide may be derived has a number average molecular weight of 550 to 2500, or 550 to 1150, and 0.1 wt % to 6 wt %, or 0.2 wt % to 5 wt %, 0.5 wt % to 4 wt % 0.5 wt % to 3 wt % of a non-borated polyisobutylene succinimide, wherein the polyisobutylene from which polyisobutylene succinimide may be derived has a number average molecular weight of 350 to 5000, or 750 to 3000 or 1350 to 2500, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the phenol-based detergent may be chosen from a non-sulphur containing phenate, a sulphur-coupled phenate, a salixarate, a salicyclate, a saligenin, and mixtures thereof, the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

In one embodiment the disclosed technology provides a lubricating composition consisting essentially of:

an oil of lubricating viscosity, a dispersant package of:

0.1 wt % to 4 wt %, 0.1 to 3 wt %, or 0.2 wt % to 2 wt %, or 0.3 wt % to 1 wt % of a borated polyisobutylene succinimide dispersant, wherein the polyisobutylene from which the borated polyisobutylene succinimide may be derived has a number average molecular weight of 550 to 2500, or 550 to 1150, and 0.1 wt % to 6 wt %, or 0.2 wt % to 5 wt %, 0.5 wt % to 4 wt % 0.5 wt % to 3 wt % of a non-borated polyisobutylene succinimide, wherein the polyisobutylene from which polyisobutylene succinimide may be derived has a number average molecular weight of 350 to 5000, or 750 to 3000 or 1350 to 2500, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the phenol-based detergent may be sulphur-free, the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

In one embodiment the disclosed technology provides a lubricating composition consisting essentially of:

an oil of lubricating viscosity, a dispersant package of:

0.1 wt % to 4 wt %, 0.1 to 3 wt %, or 0.2 wt % to 2 wt %, or 0.3 wt % to 1 wt % of a borated polyisobutylene succinimide dispersant, wherein the polyisobutylene from which the borated polyisobutylene succinimide may be derived has a number average molecular weight of 550 to 2500, or 550 to 1150, and 0.1 wt % to 6 wt %, or 0.2 wt % to 5 wt %, 0.5 wt % to 4 wt % 0.5 wt % to 3 wt % of a non-borated polyisobutylene succinimide, wherein the polyisobutylene from which polyisobutylene succinimide may be derived has a number average molecular weight of 350 to 5000, or 750 to 3000 or 1350 to 2500, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the phenol-based detergent may be chosen from, a salixarate, a salicyclate and mixtures thereof, the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

In one embodiment the disclosed technology provides a lubricating composition consisting essentially of:

an oil of lubricating viscosity, a dispersant package of:

0.1 wt % to 4 wt %, 0.1 to 3 wt %, or 0.2 wt % to 2 wt %, or 0.3 wt % to 1 wt % of a borated polyisobutylene succinimide dispersant, wherein the polyisobutylene from which the borated polyisobutylene succinimide may be derived has a number average molecular weight of 550 to 2500, or 550 to 1150, and 0.1 wt % to 6 wt %, or 0.2 wt % to 5 wt %, 0.5 wt % to 4 wt % 0.5 wt % to 3 wt % of a non-borated polyisobutylene succinimide, wherein the polyisobutylene from which polyisobutylene succinimide may be derived has a number average molecular weight of 350 to 5000, or 750 to 3000 or 1350 to 2500, an alkali earth metal sulphonate detergent present in an amount to provide at least 1 wt % sulphonate soap to the lubricating composition, an alkaline earth metal phenol-based detergent present in amount to provide at least 3.5 wt % phenol-containing soap to the lubricating composition, wherein the phenol-based detergent may be a salixarate, or mixtures thereof, the a sulphonate detergent comprises a mixture of a 300 TBN or higher alkaline earth metal sulphonate detergent having a metal ratio of 10 to 40, and a TBN of less than 100 (or 85 or less) alkaline earth metal sulphonate detergent having a metal ratio of 1 to 6 (or 1 to 5), the sulphonate detergent provides no more than 50% of the total base number derived from a detergent, and the lubricating composition has a total base number of 10 to 25 mg KOH/g.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulphur, oxygen, and nitrogen.

In general, no more than two, or no more than one, non-hydrocarbon substituent will be present for every ten carbon atoms in the hydrocarbyl group; alternatively, there may be no non-hydrocarbon substituents in the hydrocarbyl group.

The following examples provide illustrations of the invention. These examples are non-exhaustive and are not intended to limit the scope of the invention.

EXAMPLES

Comparative Lubricant 1 (CE1): is a SAE50 lubricating composition containing 8 wt % (including 27% diluent oil) calcium phenate detergent having a TBN of 145, 1 wt % (including 33 wt % diluent oil) borated polyisobutylene succinimide, 0.75 wt % (including 42 wt % diluent oil) of calcium sulphnate overbased detergent having a TBN of 400, 27 wt % brightstock, and remainder API Group I base oil.

Example 1 (EX1): is a SAE50 lubricating composition containing 8 wt % (including 27% diluent oil) calcium phenate detergent having a TBN of 145, 1 wt % (including 33 wt % diluent oil) borated polyisobutylene succinimide, 0.75 wt % (including 42 wt % diluent oil) of calcium sulphonate overbased detergent having a TBN of 400, 3 wt % (including 50% diluent oil) calcium sulphonate having a TBN of 15, 27 wt % brightstock, and remainder API Group I base oil.

Example 2 (EX2): is a SAE50 lubricating composition containing 5.5 wt % (including 27% diluent oil) calcium phenate detergent having a TBN of 145, 1 wt % (including 33 wt % diluent oil) borated polyisobutylene succinimide, 0.75 wt % (including 42 wt % diluent oil) of calcium sulphnate overbased detergent having a TBN of 400, 3 wt % (including 50% diluent oil) calcium sulphonate having a TBN of 15, 3 wt % (including 51% diluent oil) calcium salixarate having a TBN of 115, 27 wt % brightstock, and remainder API Group I base oil.

Example 3 (EX3): is a SAE50 lubricating composition containing 5 wt % (including 27% diluent oil) calcium phenate detergent having a TBN of 145, 1 wt % (including 33 wt % diluent oil) borated polyisobutylene succinimide, 6 wt % (including 35% diluent oil) a polyisobutylene succinimide having a polyisobutylene with a number average molecular weight of 1550), 0.75 wt % (including 42 wt % diluent oil) of calcium sulphnate overbased detergent having a TBN of 400, 3 wt % (including 50% diluent oil) calcium sulphonate having a TBN of 15, 2.5 wt % (including 51% diluent oil) calcium salixarate having a TBN of 115, 9.2 wt % brightstock, and remainder API Group I base oil.

Test 1: Panel Coker Deposit Test

Each example is evaluated in the Panel Coker deposit test. Approximately 300 g of each lubricant is placed in a 350 ml Panel Coker apparatus and heated to 325° C. The sample is splashed against a metal plate for 15 seconds and then baked for 45 seconds. The splashing and baking cycle is continued for approximately 16 hours. The sample is cooled to room temperature and the amount of deposits left on the metal plate is weighed. The results obtained by testing the lubricants of the indicated Examples are as shown:

| Example | CE1 | EX1 | EX2 | EX3 |
|---|---|---|---|---|
| Rating | 88 | 95 | 99 | 100 |

Test 2: Hot Tube Deposit Test

Each example is evaluated in the hot Tube deposit test. Approximately 4 ml of oil being pumped through a 1 mm bore, 265 mm length of glass tube over a 16 hour test period at 305° C. Flow is aided by the use of 10 ml/min. of air. The results obtained by testing the lubricants of the indicated Examples are as shown:

| Example | CE1 | EX1 | EX2 | EX2 |
|---|---|---|---|---|
| Rating 1 | 0 | 33 | 87 | 94 |
| Rating 2 | 0 | 12 | 87 | 85 |
| Rating 3 | 0 | 18 | 90 | 83 |

Test 3: Komatsu Hot Tube Test

Each example is evaluated in the Komatsu Hot Tube Test. The Komatsu Hot Tube Test evaluates the high temperature stability of a lubricating composition. Oil droplets are pushed up by air inside a heated narrow glass capillary tube and the thin film oxidative stability of a lubricant is measured. A rating of 0 refers to heavy deposit formation and a rating of 10 means a clean glass tube at the end of the test. The test is run at 320° C. and is described in SAE paper 840262. The results obtained are:

| Example | CE1 | EX1 | EX2 | EX3 |
|---|---|---|---|---|
| Rating | 8 | 9 | 9.5 | 9.5 |

The results indicate that the presently disclosed technology provides a lubricating composition with at least one of the following properties (i) decreased deposit formation, (ii) decreased formation of sulphated ash and/or (iii) improved cleanliness.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

an oil of lubricating viscosity, a) 0.2 to 2 wt % of a borated succinimide dispersant, b) 0.5 to 3 wt % of a calcium sulphonate detergent having a TBN of 300 or higher and a metal ratio of 10 to 40, c) 1.5 to 6 wt % of a calcium sulphonate detergent having a TBN of less than 100 and a metal ratio of 1 to 6, d) 1 to 6 wt % of a calcium or magnesium sulphur containing phenate, and e) and 0.5 to 4 wt % of a phenol-based detergent chosen from, a salixarate, a salicylate, and mixtures thereof; and wherein the lubricating composition has a total base number of 10 to 25 mg KOH/g.

2. The lubricating composition of claim 1, wherein the dispersant comprises a borated polyisobutylene succinimide dispersant, wherein the polyisobutylene from which the borated polyisobutylene succinimide is derived has a number average molecular weight of 550 to 2500.

3. The lubricating composition of claim 1, wherein the lubricating composition does not contain an antioxidant or corrosion inhibitor.

4. The lubricating composition of claim 1, wherein the lubricating composition disclosed herein does not contain a foam inhibitor, a demulsifier, a pour point depressant or mixtures thereof.

5. The lubricating composition of claim 1, wherein further comprising zinc dialkyldithiophosphate typically present at 0.1 wt % to 5 wt % of the lubricating composition.

6. The lubricating composition of claim 1, wherein the lubricating composition disclosed herein does not contain zinc dialkyldithiophosphate.

7. The lubricating composition of claim 1, wherein the oil of lubricating viscosity is an API Group I or II, or mixtures thereof base oil.

8. The lubricating composition of claim 1, wherein the lubricating composition is a SAE 50 or SAE 60 lubricant.

9. The lubricating composition of claim 1, wherein the calcium or magnesium sulphur containing phenate has a TBN of 80 to less than 180 and a metal ratio of 0.05 to less than 2.

10. A method of lubricating a 2-stroke marine diesel internal combustion engine comprising supplying to the internal combustion engine a lubricating composition of claim 1.

11. The method of claim 10, wherein the lubricating composition is used to lubricate the 2-stroke marine diesel cylinder liner.

* * * * *